US007234503B2

(12) United States Patent
Kwak

(10) Patent No.: US 7,234,503 B2
(45) Date of Patent: Jun. 26, 2007

(54) ROLL SCREEN FOR REDUCTION DEVICE

(76) Inventor: Jae-Suk Kwak, #1078-4, Daerim-dong, Yeongdeungpo-gu, Seoul 150-825 (KR)

( * ) Notice: Subject to any disclaimer, the term of this patent is extended or adjusted under 35 U.S.C. 154(b) by 102 days.

(21) Appl. No.: 10/530,710

(22) PCT Filed: Dec. 4, 2003

(86) PCT No.: PCT/KR03/02652

§ 371 (c)(1),
(2), (4) Date: Apr. 8, 2005

(87) PCT Pub. No.: WO2004/051047

PCT Pub. Date: Jun. 17, 2004

(65) Prior Publication Data

US 2006/0162876 A1 Jul. 27, 2006

(30) Foreign Application Priority Data

Dec. 4, 2002 (KR) ..... 20-2002-0036310 U
Dec. 3, 2003 (KR) ..... 20-2003-0037720 U

(51) Int. Cl.
*E06B 9/56* (2006.01)

(52) U.S. Cl. ..... 160/296; 160/295

(58) Field of Classification Search ..... 160/296, 160/299, 295, 291, 293.1, 301, 305, 317, 160/321, 171, 8
See application file for complete search history.

(56) References Cited

U.S. PATENT DOCUMENTS 1,885,400 A * 11/1932 Ygger ..... 160/295
5,437,324 A * 8/1995 Sternquist ..... 160/299
6,155,328 A * 12/2000 Welfonder ..... 160/313
6,467,714 B1 * 10/2002 Rasmussen ..... 242/381
6,938,667 B2 * 9/2005 Sugiyama et al. ..... 160/296
6,955,207 B2 * 10/2005 Minder ..... 160/298

FOREIGN PATENT DOCUMENTS

| | | |
|---|---|---|
| EP | 0976909 | 2/2000 |
| JP | 8-49484 | 2/1996 |
| JP | 1217973 | 1/2000 |
| JP | 2000-80872 | 3/2000 |
| JP | 2000-320278 | 11/2000 |

OTHER PUBLICATIONS

English Language abstract of JP 12-17973.
English Language abstract of JP 8-49484.
English Language abstract of JP 2000-320278.
English Language abstract of JP 2000-80872.

* cited by examiner

*Primary Examiner*—David Purol
(74) *Attorney, Agent, or Firm*—Greenblum & Bernstein, P.L.C.

(57) ABSTRACT

The present invention relates to a reduction device for a roll screen, as a compressive piston of a reduction part comes in and out inside of a cylinder combined with a one end of inside of a winding bar, to a device being capable of winding and loosening the roll screen easily and conveniently, more particularly to a device being capable of preventing a noise, an impact and a safety-accident and being capable of operating easily without distinction of age or sex, young and old, men and women all alike, due to a winding of the roll screen by way of reducing a speed of the roll screen with a definite section while the roll screen is wound.

8 Claims, 13 Drawing Sheets

ROLL SCREEN FOR REDUCTION DEVICE

TECHNICAL FIELD

The present invention relates to a reduction device for a roll screen, particularly to a device being capable of winding and unwinding the roll screen easily and conveniently, more particularly to a device being capable of preventing a noise, an impact and a safety-accident and being capable of operating easily without distinction of age or sex, young and old, men and women all alike, due to a winding of the roll screen by way of reducing a speed of the roll screen with a definite section while the roll screen is wound.

BACKGROUND ART

Generally, a roll screen is used in a substitution for a curtain, with operating in a way of winding or unwinding the screen round a winding bar, and when one pulls a handle bar, the screen is wound or unwinding by overcoming an elastic force of the winding spring. The roll screen may use as a decorative goods represented various photos, pictures and etc by taking a computer photograph, a substitute of a framed family-picture on a wall or a window, and a mosquito net.

Since the prior roll screen is wound instantaneously by an elastic force of a winding spring when the roll screen is wound around a winding bar, the instantaneous winding makes a user surprising and induces a noise.

That is, since the roll screen is wound around the winding bar by a elastic force of the winding spring put under torsional pressure, and the screen is wound faster and faster following the screen wounded with increasing speed, the handle bar bumps into a case collecting the winding bar, thereby a noise is occurred.

DISCLOSURE OF THE INVENTION

Accordingly, the present invention has been made to solve the above-mentioned problems occurring in the prior art. The object of the present invention is to provide a reduction device for a roll screen being capable of preventing a roll screen from winding instantaneously and giving a user a convenience.

Another object of the present invention is to provide reduction device for a roll screen being capable of preventing a noise, an impact and a safety-accident by remarkably reducing a winding speed of the roll screen as a compressive piston of a reduction part which is compressed into the cylinder with a rotating force of a rotating nut is nearly ceased by an air tight ring, and by softly winding the roll screen as an air in the piston is ejected slowly by an air-ejecting groove.

In order to accomplish these objects, according to the invention, there is provided an reduction device for a roll screen comprising a fixing axis formed in a winding bar and a damper combined with the fixing axis and reducing a winding speed of the roll screen, wherein the damper includes the fixing axis of which a screw thread part is formed on the peripheral surface, a inserting groove inserted a screen-inserting part of the winding bar, and one of a spring, a cushion, a bellows and a buffer between the reduction nut and the adjuster.

Further, the reduction device comprises a fixing axis of which a screw thread part is formed on a peripheral surface and a combining groove is formed at one end, a rotating nut of which a plurality of fixing grooves are formed on a peripheral surface and a rotating groove is formed in a middle, a reduction part of which a long guide groove is formed on the upper and the bottom surface, a compressive piston is formed at the rear, and an elastic spring is combined with a peripheral surface, a cylinder of which a combining groove 341 is formed on one end, and a fixing groove combining the cylinder and the fixing axis with the long guide groove of the reduction part.

BEST MODE FOR CARRYING OUT THE INVENTION

Hereinafter, preferred embodiments of the present invention will be described with reference to the accompanying drawings. In the following description of the present invention, a detailed description of known functions and configurations incorporated herein will be omitted when it may make the subject matter of the present invention rather unclear.

Figure 1:
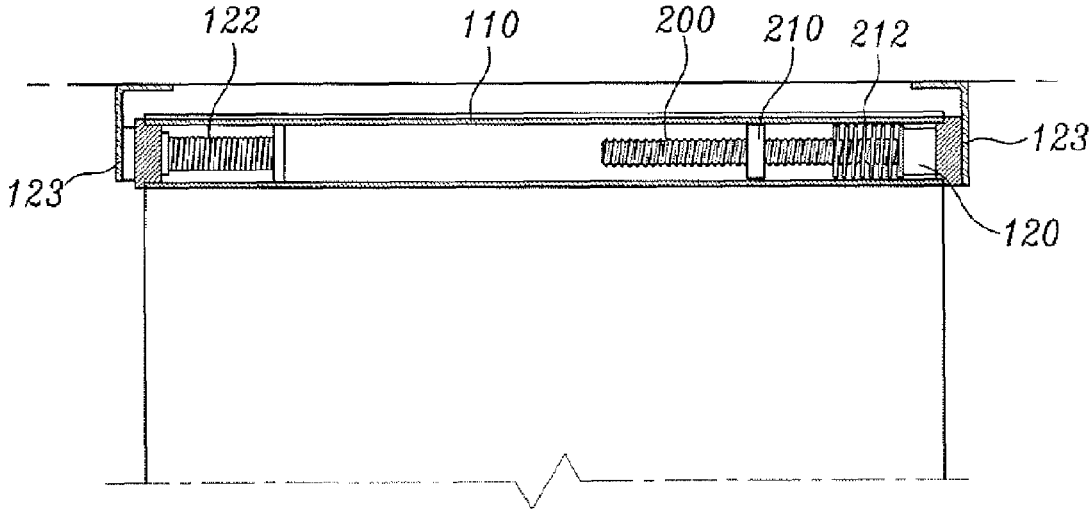
FIG. 1 is a cross sectional view of one configuration of a reduction device for a roll screen according to the present invention.
Figure 2:
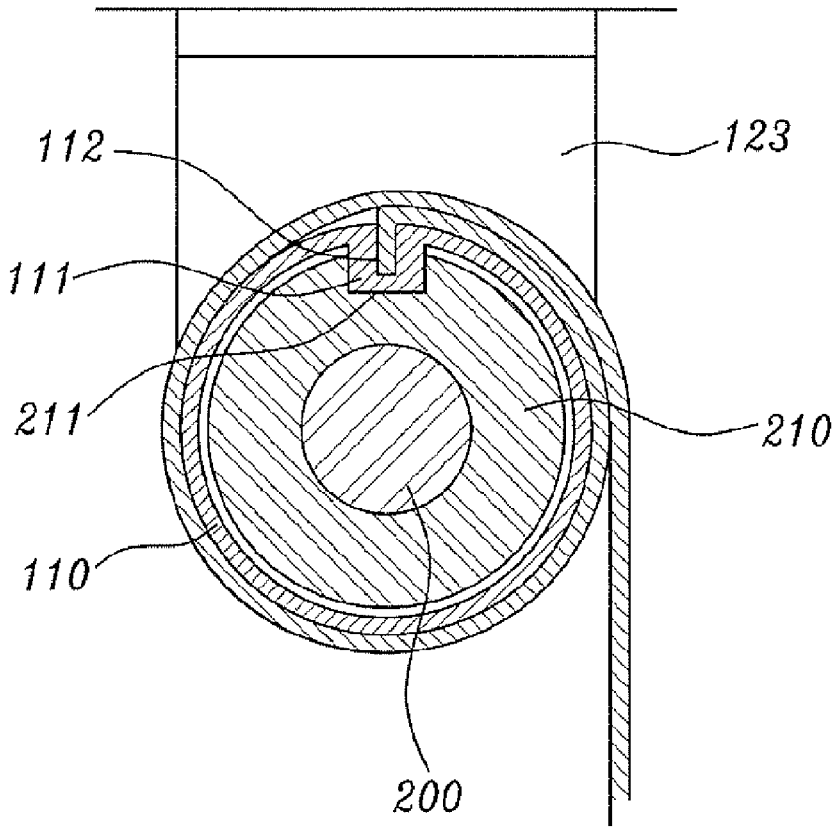
FIG. 2 is a cross sectional view of a principal part of the roll screen according to the present invention.

FIG. 1 and FIG. 2 show one embodiment of a reduction device for a roll screen according to the present invention comprising a roll screen 100, a winding bar 110 supporting the roll screen 100, wherein a bracket 123 is formed at both side ends of the winding bar 110 in order to install the roll screen 100 on a wall, a ceiling, a window frame, etc., and a winding spring 122 formed on one side of an inside of the winding bar 110.

The winding bar 110 further comprises a screen-inserting part 111 having a screen-inserting groove 112 in a longitudinal direction, and the roll screen is wound or unwound about the winding bar 110 by inserting one end of the roll screen 100 in the screen-inserting groove 112.

Further, a fixing axis 200 is formed longitudinally on the other side of an inside of the winding bar 110, a screw thread part 201 is formed on the peripheral surface of the fixing axis 200, and one end of the fixing axis 200 is combined with the bracket 123.

A reduction nut 210 is combined by gear with the fixing axis 200, a screw thread part 211*a* is formed in the inner surface of the reduction nut 210, a spring 212 is formed between the reduction nut 210 and the bracket 123, and an inserting groove 211 is formed on one side of the reduction nut 210, such that the inserting groove 211 is combined with the screen-inserting part 111 of the winding bar 110.

In the above statement, the screw thread part 201 of the fixing axis 200 is an external thread and the screw thread part 211*a* is an internal thread corresponding to the external thread.

Therefore, since the reduction nut 210 is combined by gear with the fixing axis 200, as the winding bar 110 is rotated during the roll screen 100 being wound, the reduction nut 210 moves in a defined direction following the screw thread part 201 of the fixing axis 200, and the roll screen 100 reduces its speed at a defined point and is wound more slowly.

That is, when the roll screen 100 is wound with the winding bar 110, the reduction nut 210 is located near the bracket 120, and the spring 212 is compressed by the reduction nut 210.

In the compressed condition, when one pulls a ball chain rope 121, the roll screen 100 is loosened by overcoming an elastic force of the winding spring 122, thereby the winding bar 110 rotates, and the reduction nut 210 rotates caused by rotation of the winding bar 110 and moves toward the winding spring 122. As a result, the spring 212 is discharged from the compressive force, and the winding spring 122 is subject to a torsional pressure.

By the above method, when the roll screen 100 is unwound entirely, the roll screen 100 covers a window by fixing a finishing bar (not disclosed) formed in the bottom of the roll screen 100.

Further, when one releases the fixation of the finishing bar, due to a return elastic force of the winding spring 122 put under the tortional pressure, the winding bar 110 rotates in a reverse direction, the roll screen 100 is wound by the winding bar 110, and the reduction nut 210 rotates on the fixing axis 200 and moves near to the bracket 120. Further, when the reduction nut 210 moves to a defined distance, the reduction nut 210 contacts the spring 212. Since the elastic force of the spring 212 is weaker that that of the winding spring 122, the reduction nut 210 moves with rotation continuously and compresses the spring 212.

As a result, the winding bar 110 reduces its speed, and the roll screen 100 is wound softly and noise suppressed.

That is, when the roll screen 100 is unwound entirely, the reduction nut 210 moves toward the fixing axis 200, and when the roll screen 100 is wound, the reduction nut 210 moves along the fixing axis 200 toward bracket 120. When the roll screen 100 is wound about two third (that is, when the reduction nut 210 moves about two thirds along the fixing axis 200), the reduction nut 210 contacts the spring 212 and compresses the spring 212.

Therefore, two thirds of the roll screen 100 is wound quickly, and one third of the roll screen 100 is wound slowly, thereby noise is suppressed and the roll screen 100 has high quality.

Figure 4:
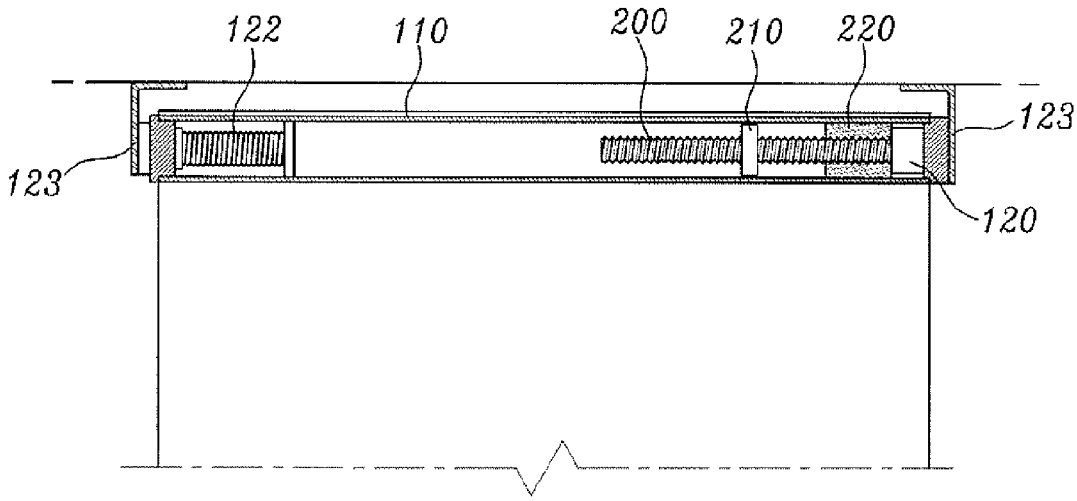
FIGS. 4 to 6 are cross sectional views of another configuration of a reduction device for the roll screen according to the present invention.

FIG. 4 shows another embodiment of a reduction device for a roll screen according to the present invention comprising a cushion material 220 such as a rubber material, a synthetic resin, a sponge, etc. formed between a reduction nut 210 and bracket 120. A process of compressing the spring 212 and reducing the roll screen 100 of the first embodiment is equal to that of compressing the cushion material 220 and reducing the roll screen 100.

Figure 3:
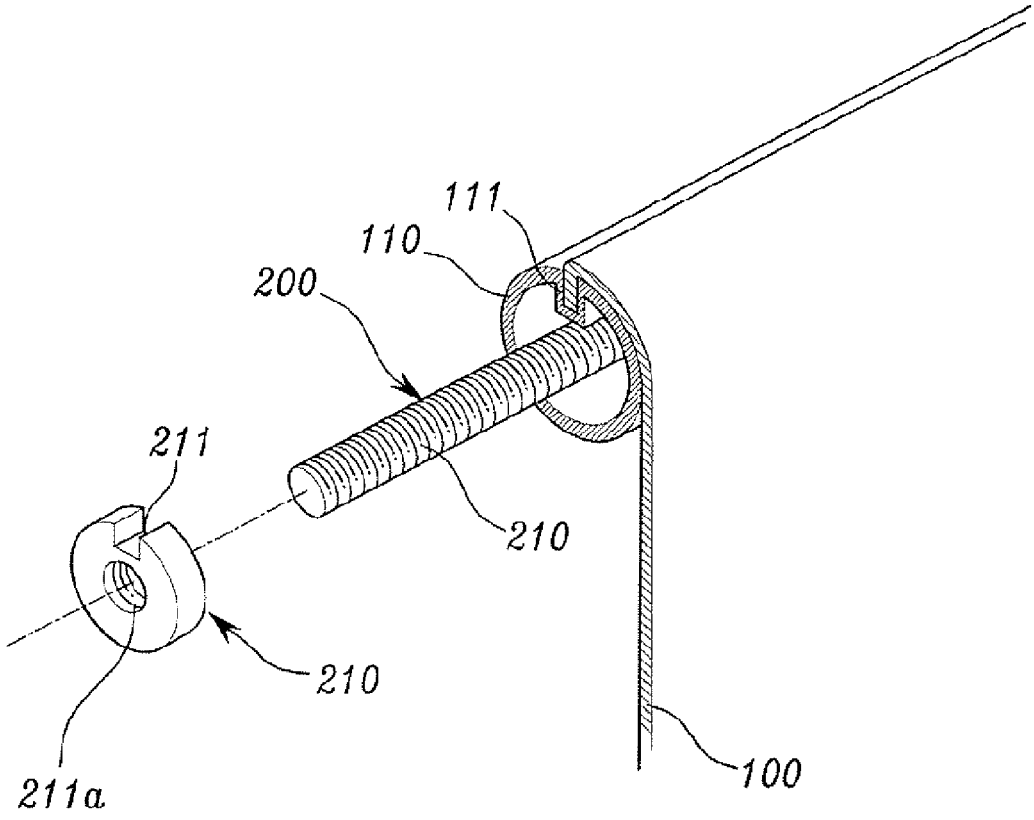
FIG. 3 is a cross sectional perspective view of a principal part of the roll screen according to the present invention.
Figure 5:
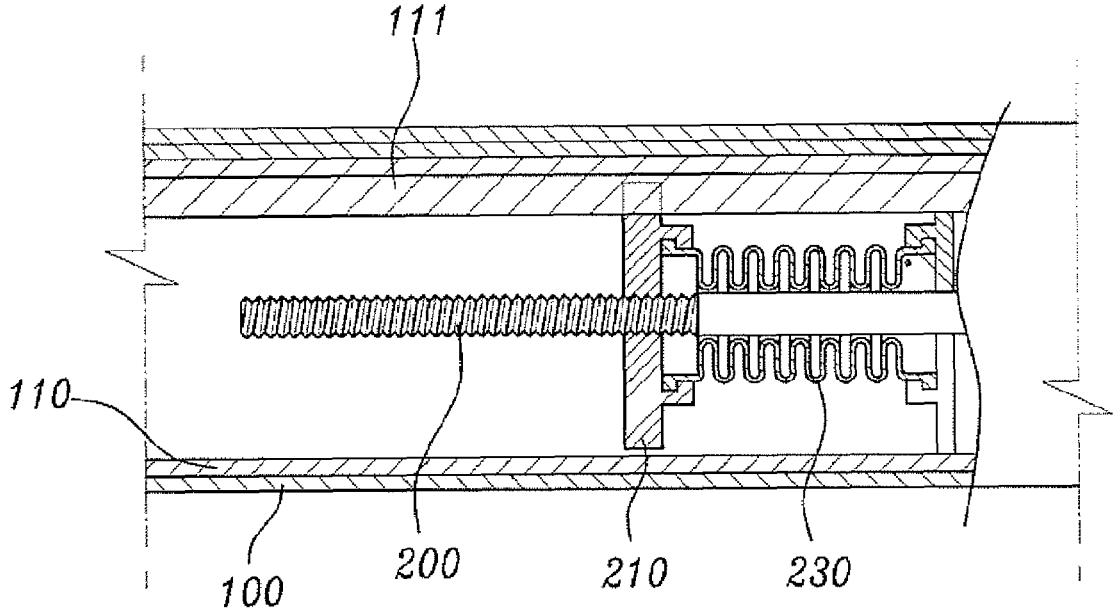

FIG. 5 shows another embodiment of a reduction device for a roll screen according to the present invention comprising a bellows 230 formed between the reduction nut 210 combined by gear with a fixing axis 200 and a bracket 120, wherein an inserting groove 211 (as illustrated in FIG. 3) located on the upper part of the reduction nut 210 is fit onto a screen-inserting part 111, and the bellows 230 is extended and shrunk by the reduction nut 210, thereby the winding speed of a roll screen may be reduced.

Figure 6:
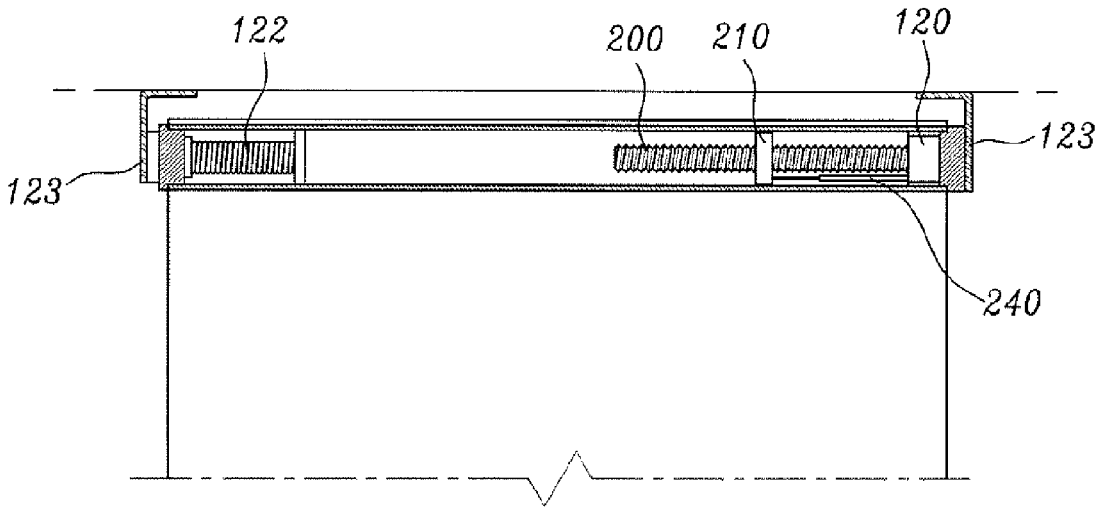

FIG. 6 shows another embodiment of a reduction device for a roll screen according to the present invention comprising a buffer 240 operated as a damper by oil pressure or air pressure, wherein one side of the buffer 240 is combined with a bracket 120 and the other side is combined with the reduction nut 210. In the embodiment, when the reduction nut 210 moves to the buffer 240, the load on the buffer increases and the winding speed of a roll screen may be reduced.

Figure 7:
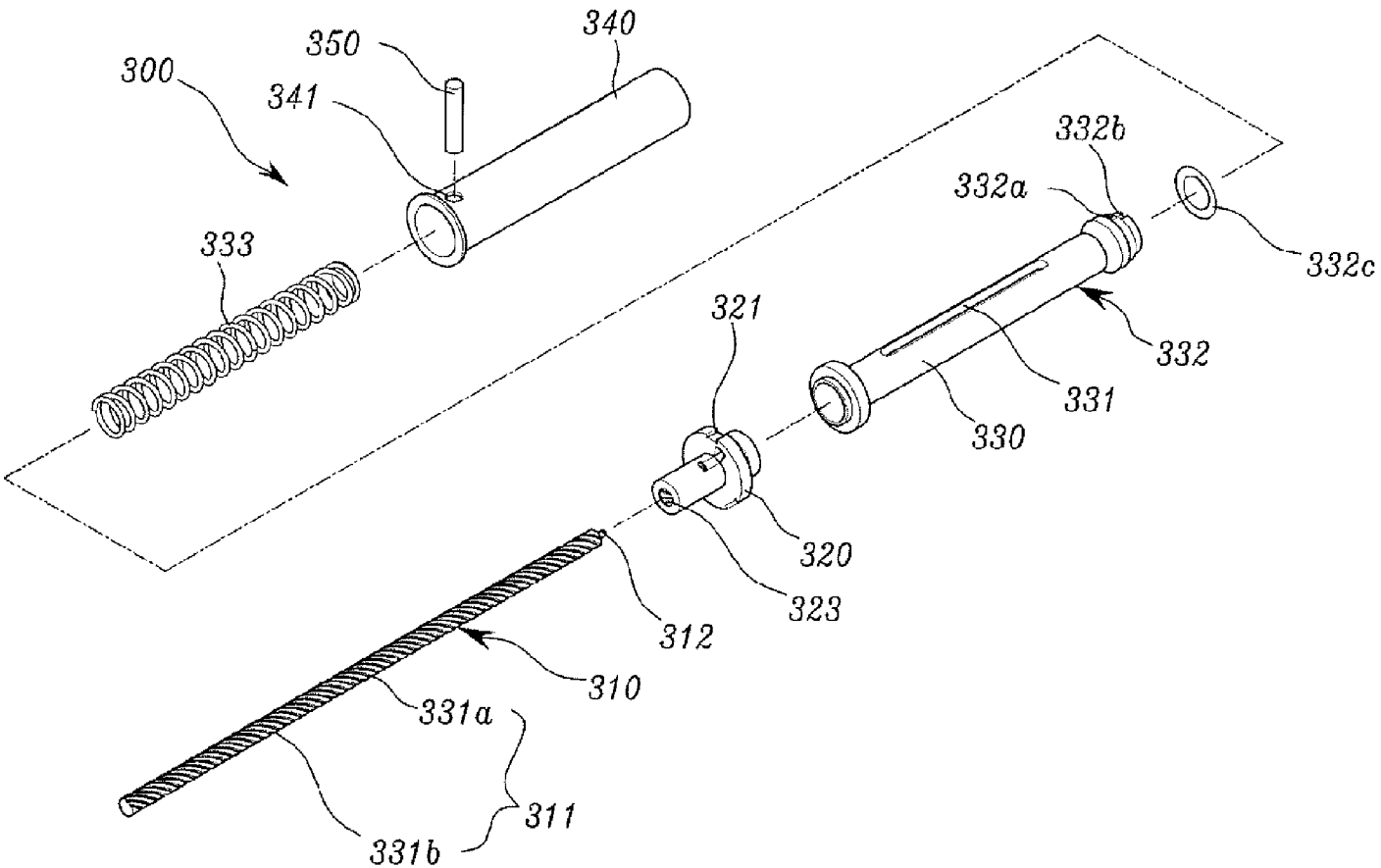
FIG. 7 is an exploded perspective view of another configuration of a reduction device for a roll screen according to the present invention.

As shown in FIG. 7, a reduction device according to the present invention comprises a fixing axis 310 having a screw thread part 311 formed on a peripheral surface thereof, a rotating nut 320 having a rotating groove 323 and an inserting groove 321 formed on a peripheral surface thereof, a reduction part 330 having a long guide groove 331 and a compressive piston 332, and combined an elastic spring 333, a cylinder 340 having a combining groove 341 formed on one end of the cylinder 340, and fixing groove 360 combining the cylinder 340 and the fixing axis 310 with the long guide groove 331 of the reduction part 330.

The screw thread part 311 is formed on the peripheral surface of the fixing axis 310 and a fixing groove 312 is formed on one end of the fixing axis 310. The screw thread part 311 consists of a screw thread 311*a* and a screw hollow 311*b*. Further, a fixing groove 360 is combined with the fixing groove 312.

Figure 8:
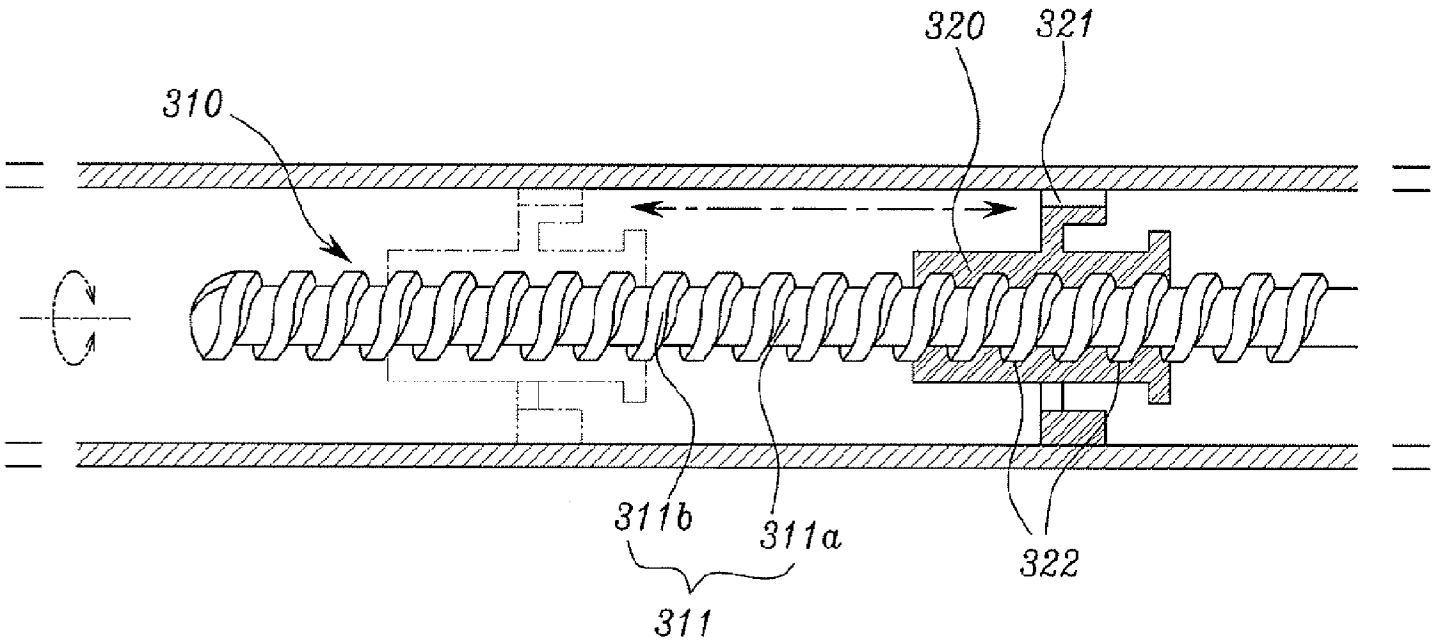
FIG. 8 is a cross sectional view depicting an operating condition of the rotating nut of FIG. 7.

As shown in FIG. 8, a plurality of inserting grooves 321 are formed on the peripheral surface of the rotating nut 320, and the rotating groove 323 having a screw thread part 322 formed on an inner surface thereof penetrates the middle of the rotating nut 320. The screw thread part 322 of the rotating groove 323 is combined with the screw thread part 311 of the fixing axis 310, and rotates from side to side. Since a screen-inserting part 111 of a winding bar 110 is inserted in the inserting groove 321, when the rotating nut 320 is rotated, the winding bar 110 of which the roll screen 100 is wound around is rotated.

The reduction part 330 has a cylindrical shape, with a long guide groove 331 on the upper and the lower outside surfaces, and a compressive piston 332 at the rear, and is combined with an elastic spring 333 at the peripheral surface. By inserting the rear of the fixing axis 310 with a definite space into the reduction part 330, the reduction part 330 is located on the rear of the rotating nut 320.

The cylinder 340 has a combining groove 341 at the upper surface and is combined with the compressive piston 332 at an inner part. Further, one end of the cylinder 340 is fixed to the bracket 120 combined with an inner part of the winding bar 110.

The fixing groove 350 fixes the cylinder 340 and the fixing axis 310 into the uppermost of the long guide grooves 331 of the reduction part 330. More particularly, as the fixing groove 312 of the fixing axis 310 combined with at the inner part of the reduction part 330 is put on the uppermost of the long guide groove 331, and the combining groove 341 of the cylinder 340 coincides with the fixing groove 312 of the fixing axis 310, the fixing groove 350 is inserted and fixed. At this point, the elastic spring 333 is put to on the front of the fixing groove.

The compressive piston 332 has a U-shaped transferring part 332*a* at the middle of the peripheral surface, and has an air-ejecting groove 332*b* at both sides of the bottom. An air tight ring 332*c* is combined with the transferring part 332*a*.

Because the air tight ring 332*c* is made of a rubber and has the shape of an O-ring, the air-tight ring 332*c* is easily desorbed and is good in air-tight property.

Figure 9A:
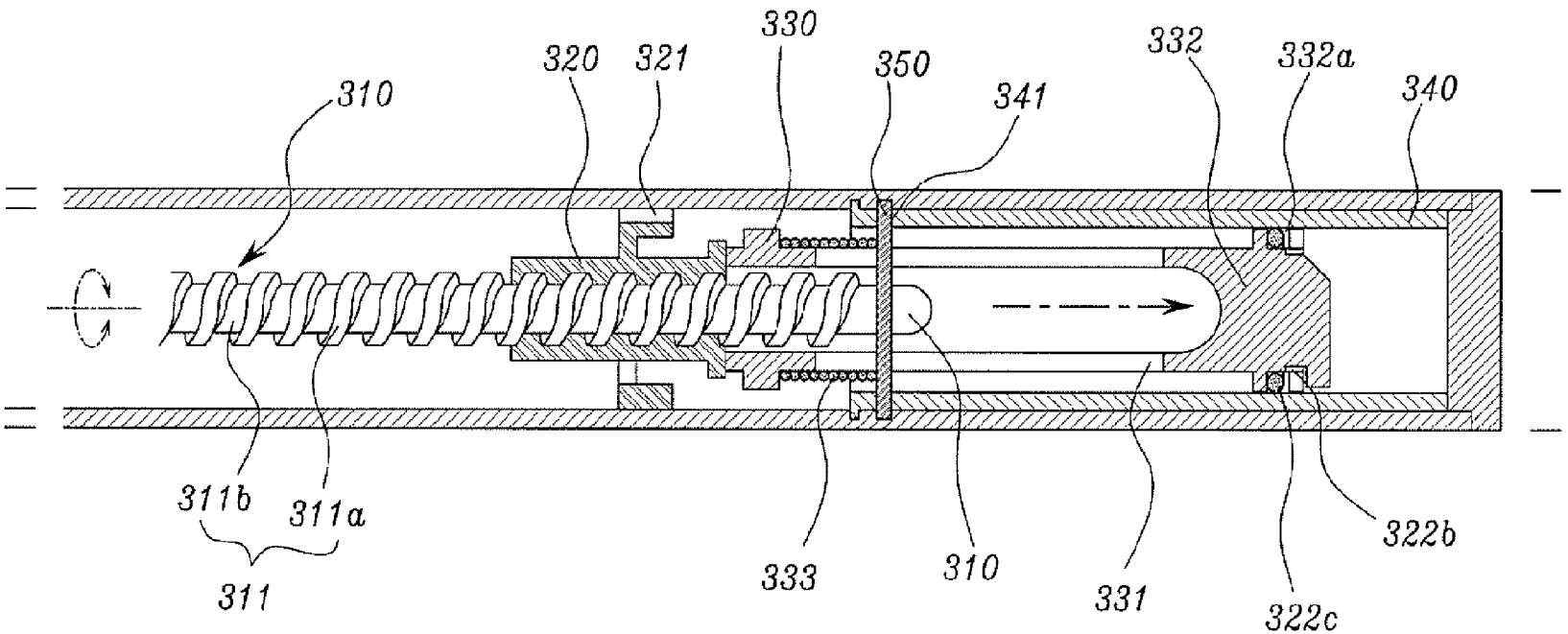
FIGS. 9*a* and 9*b* are a cross sectional views of depicting an operating condition of a reduction part according to the present invention.

When the above compressive piston 332 is inserted into the cylinder 340, as shown in FIG. 9*a*, since the air tight ring 332*c* combined with the transferring part 332*a* is positioned to the front, and covers tightly air ejected from the air-ejecting groove 332*b*, the compressive piston 332 is inserted with reduced speed.

Figure 9B:
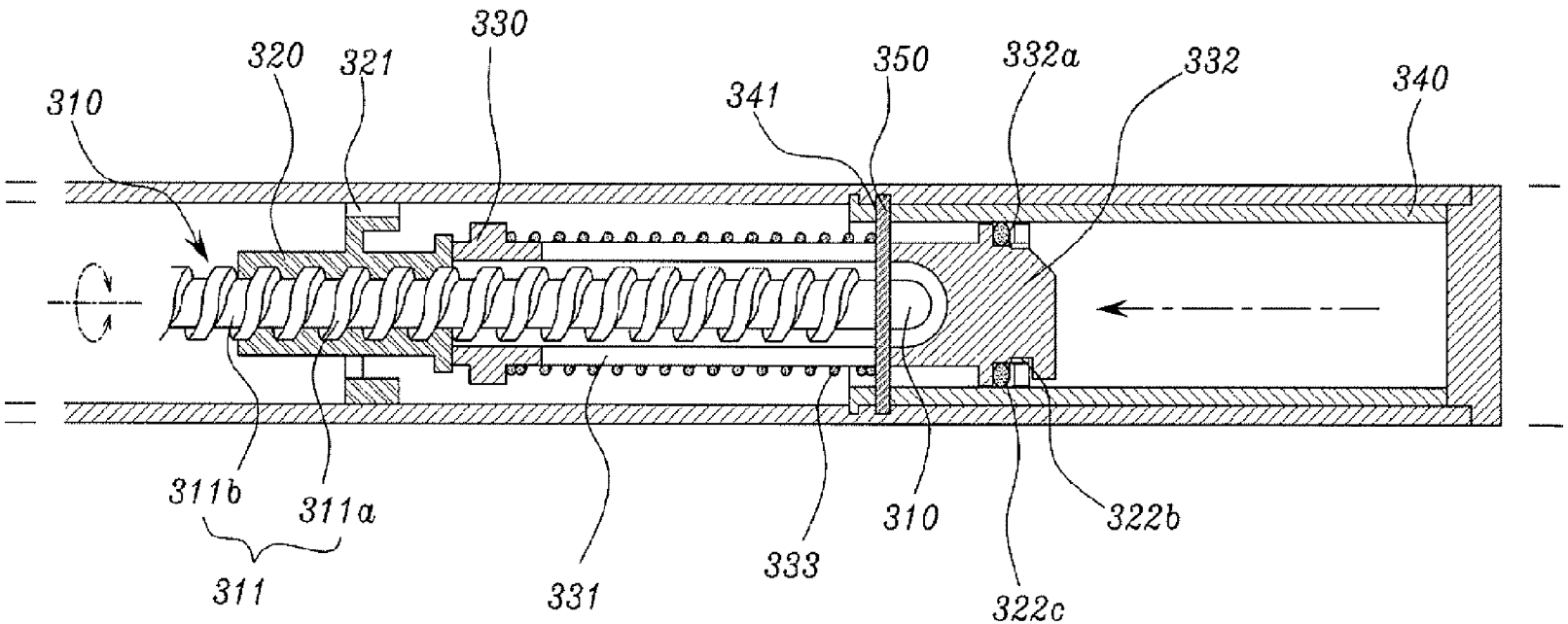

Further, as shown in FIG. 9*b*, when the compressive piston 332 inserted into the cylinder 340 is ejected, since the air tight ring 332*c* combined with the transferring part 332*a* is positioned to the back, and the air is ejected to the outside by opening the air-ejecting groove 332*b*, the compressive piston 332 is ejected easily.

Figure 10:
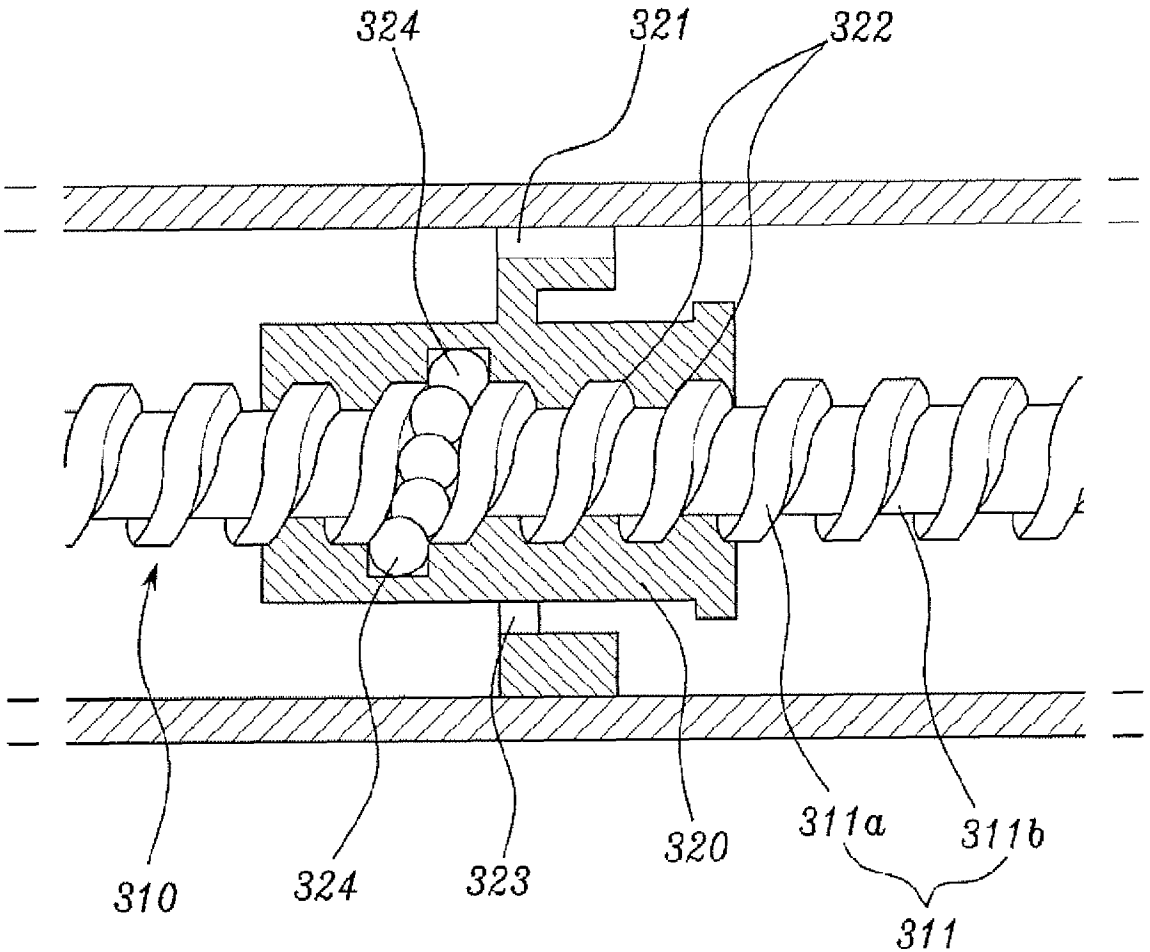
FIG. 10 is a cross sectional view of a configuration formed of a ball in a rotating nut according to the present invention.

As shown in FIG. 10, the rotating nut 320 includes a plurality of rotating balls 324 using a rotating groove 323. Since the balls 324 rotates as they are combined with a screw hollow 311*b*, the reduction device may be operated without noise and may be used for a long time.

Figure 11:
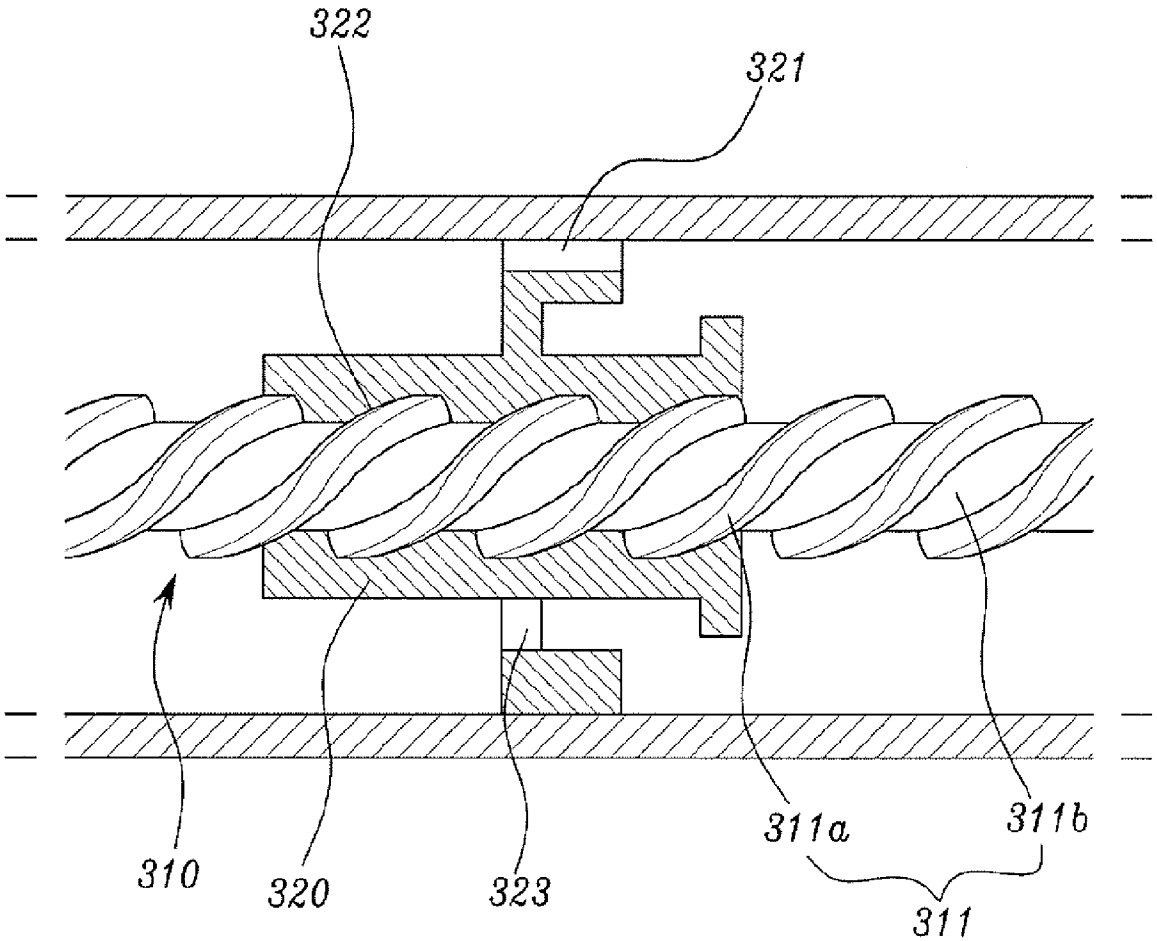
FIG. 11 is a cross sectional view of a configuration formed of a screw thread part formed in a fixing axis.

Further, as shown in FIG. 11, the screw thread part 311 formed on the peripheral surface of the fixing axis 310 performs widely a pitch of the screw thread 311*a* of the screw thread part 311 at a definite section, thereby decreasing the rotational speed of the rotating nut 320 rotating quickly.

Figure 12:
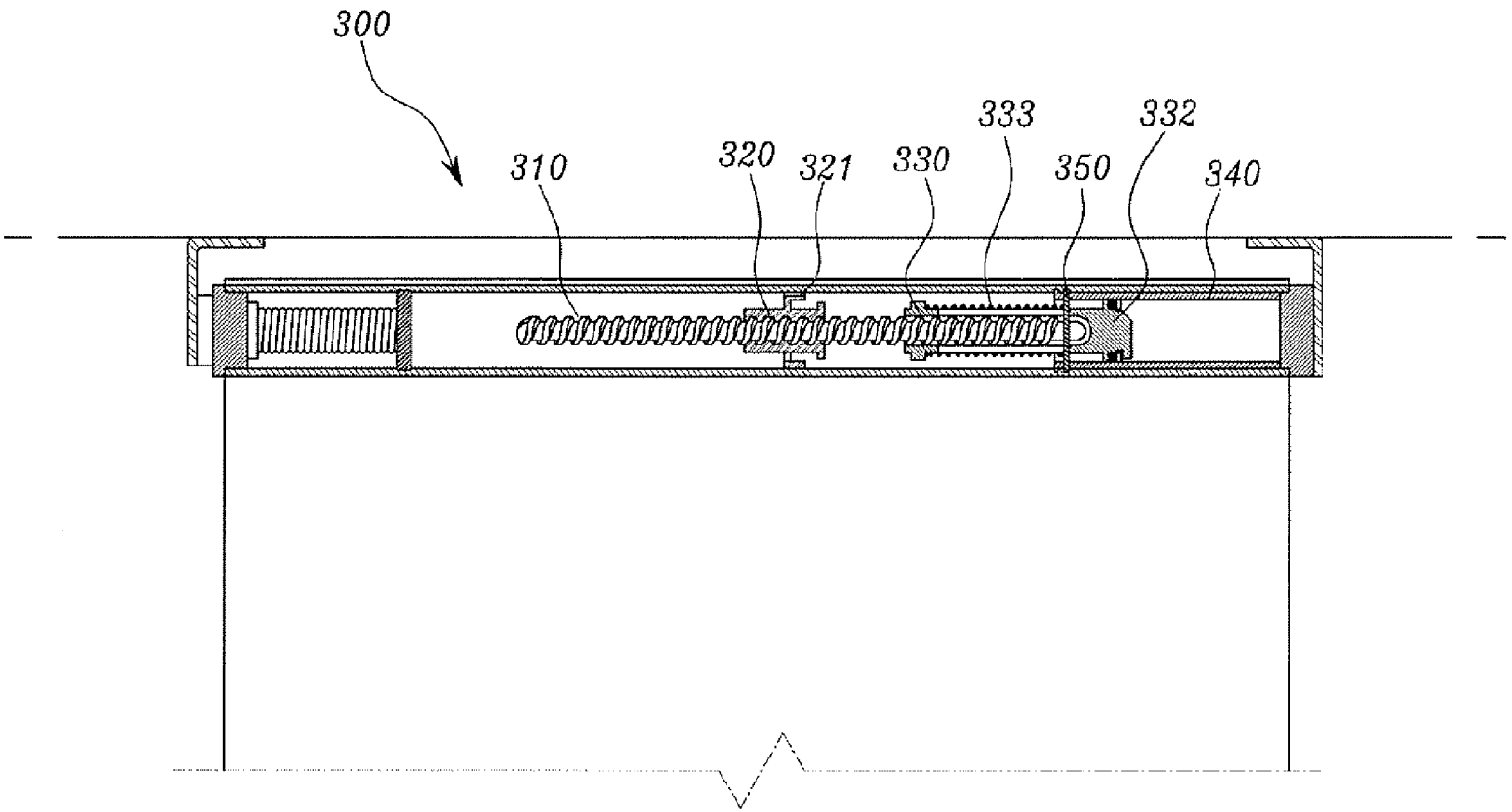
FIG. 12 is a side cross sectional view of FIG. 7.

As shown FIG. 12, the reduction device for a roll screen according to the present invention has a winding bar 110 for supporting a roll screen 100; wherein a bracket 123 is combined at both sides of the winding bar 110 in order to install the roll screen 100 on a wall, a ceiling, a window frame, etc., a winding spring 122 is combined with one side of the inner of the winding bar 110, and a reduction body 300 is combined with the other side.

In the above condition, when one pulls a handle (not disclosed) formed at the end of the roll screen 100 in a downward direction, the roll screen 100 is unwound by overcoming the elastic force of the winding spring 122, thereby the winding bar 110 rotates, and the rotating nut 320 combined with the winding bar 110 moves ahead to the winding spring 122 following the screw thread part 311 of the fixing axis 310. As a result, the spring 122 is discharged from the compression force, and is subject to a torsional pressure.

By the above method, when the roll screen 100 is unwounded entirely and the handle is fixed in the lower part, the roll screen 100 covers a window entirely.

Further, when one lifts the handle and releases the fixation, due to a return elastic force of the winding spring 122 put under tortional pressure, the winding bar 110 is rotated in the reverse direction, and the roll screen 100 is wound with the winding bar 110.

At this time, as the rotating nut 320 combined with the fixation axis 310 is rotated at the rear quickly and hits the reduction part 330, and the compressive piston 332 of the reduction part 330 moves into the cylinder, the air tight ring 332*c* moves to the front and compresses air in the cylinder 340, thereby the compressive piston 332 cannot move further to the inside of the cylinder 340.

Further, as a through hall is formed on the compression piston and is sufficiently small not to eject the above compressed air at one time, the compressive piston 332 is prevented from move further to the inside of the cylinder 340 and the rotating speed is reduced remarkably. Further, as the compressed air is ejected slowly to the outside by the through hall, an inner space is secured. It allows the reduction part 330 to move into the cylinder only to the extent of the secured space and the roll screen 100 to be wound with reduced speed, thereby the roll screen may be wound softly and noise and safety problem prevented.

Further, as the pitch of the screw thread 31*a* of the screw thread part 311 formed on the peripheral surface of the fixing axis 310 is set widely at a definite section, the rotating nut 320 may move more slowly with decreased rotation speed at the definite section, thereby safe operation is secured more reliably.

Further, when the handle of the roll screen 100 is pulled downward, as the air tight ring 332*c* of the compressive piston 332 inserted in the cylinder 340 is shifted to the back, the air is ejected easily to the outside by opening the air-ejecting groove 332*b*, thereby rotation of the rotating nut 320 is easy.

INDUSTRIAL APPLICABILITY

As disclosed above, the reduction device for the roll screen according to the present invention have an effect that when the reduction part having the compressive piston moves into the cylinder, the reduction part moves slowly as the air tight ring shuts a air-ejecting groove, thereby the roll screen may be wound softly and a noise and a safety accident may be prevented. Further, the reduction device for the roll screen according to the present invention have an effect that the rotating nut 320 may move more slowly with decreased rotation frequency at the definite section as a pitch of the screw thread formed on the peripheral surface of the fixing axis is set widely at a definite section, thereby a safety is secured more reliably.

While the invention has been shown and described with reference to certain preferred embodiments thereof, it will be understood by those skilled in the art that various changes in form and details may be made therein without departing from the spirit and scope of the invention as defined by the appended claims.

The invention claimed is:

1. A reduction device for a roll screen, the reduction device comprising:

a winding bar having brackets provided on opposite ends thereof and a winding spring provided therein, wherein the winding bar further comprises a screen inserting part having a first groove formed in a longitudinal direction of the winding bar, and configured to receive an end of the roll screen such that the roll screen is configured to be wound and unwound;

a fixing axis, having a screw threaded part formed on a peripheral surface, installed in the winding bar to operatively fix the reduction device, wherein one end of the fixing axis is coupled to at least one of the brackets; and a reduction nut having a second groove provided on its peripheral surface, which receives the screen inserting part of the winding bar, wherein the reduction nut, the fixing axis, the screen inserting part, and the winding spring are operatively connected to provide a damper assembly.

2. The device according to claim 1, wherein a cushion material is formed between the reduction nut of the damper and the adjustor.

3. The device according to claim 1, wherein the damper has a buffer formed between the reduction nut and the adjustor.

4. The device according to claim 1, wherein the damper has a bellows formed between the reduction nut and the adjustor.

5. A reduction device for a roll screen, the reduction device comprising:

a winding bar having brackets provided on opposite ends thereof and a winding spring provided therein, wherein the winding bar further comprises a screen inserting part having a first groove formed in a longitudinal direction of the winding bar, and configured to receive an end of the roll screen such that the roll screen is configured to be wound and unwound;

a fixing axis having a screw thread part formed on a peripheral surface thereof, and a coupling groove formed at one end;

a rotating nut connected to the screw thread part of the fixing axis, wherein a plurality of fixing grooves is formed on a peripheral surface of the rotating nut and a rotating groove having a screw thread part is formed in a middle of the rotating nut, wherein the rotating nut receives the screen inserting part of the winding bar;

a reduction part, inserted into the one end of the fixing axis, and having a long guide groove formed on the upper and the bottom surfaces of the reduction part, a compressive piston is formed at the rear of the reduction part, and an elastic spring is combined with a peripheral surface of the reduction part;

a cylinder having the winding bar fixed at an end of the reduction device and a coupling groove formed on one end thereof; and a fixing groove combining the cylinder and the fixing axis with the long guide groove of the reduction part.

6. The device according to claim 5, wherein the compressive piston includes a U-shape transferring part at the middle of the peripheral surface, an air-ejecting groove at both sides of the bottom, and an air tight ring combined with the transferring part and opening and closing the air-ejecting groove.

7. The device according to claim 5, wherein the rotating nut forms a plurality of rotating balls in the rotating groove to rotate along with a screw hollow.

8. The device according to claim 5, wherein the fixing axis performs widely a pitch of the screw thread.

* * * * *